United States Patent [19]

Wilfried

[11] Patent Number: 4,772,192

[45] Date of Patent: Sep. 20, 1988

[54] VANE-TYPE COMPRESSOR

[75] Inventor: Ball Wilfried, Dingolfing, Fed. Rep. of Germany

[73] Assignee: Bayerische Motoren Werke Aktiengelleschaft, Fed. Rep. of Germany

[21] Appl. No.: 60,390

[22] PCT Filed: Oct. 11, 1985

[86] PCT No.: PCT/EP85/00534

§ 371 Date: Jun. 8, 1987

§ 102(e) Date: Jun. 8, 1987

[87] PCT Pub. No.: WO87/02426

PCT Pub. Date: Apr. 23, 1987

[51] Int. Cl.[4] ..... F04C 2/00

[52] U.S. Cl. ..... 418/238; 418/266

[58] Field of Search ..... 418/238, 257, 258, 266, 418/267

[56] References Cited

U.S. PATENT DOCUMENTS

| | | | |
|---|---|---|---|
| 793,664 | 7/1905 | Kleindeinst | 418/266 |
| 1,395,916 | 11/1921 | Hayes | 418/259 |
| 3,132,847 | 5/1964 | Mercuriali | 418/238 |
| 3,286,913 | 11/1966 | Kaatz | 418/238 |
| 3,446,191 | 5/1969 | Vernon | 418/257 |
| 3,473,478 | 10/1969 | Little | 418/258 |
| 3,909,158 | 9/1975 | Martin | 418/297 |

FOREIGN PATENT DOCUMENTS

| | | | |
|---|---|---|---|
| 2117102 | 10/1971 | Fed. Rep. of Germany . | |
| 3324878 | 1/1987 | Fed. Rep. of Germany . | |
| 61-241482 | 10/1986 | Japan | 418/266 |

*Primary Examiner*—Carlton R. Croyle
*Assistant Examiner*—T. Olds
*Attorney, Agent, or Firm*—Barnes & Thornburg

[57] ABSTRACT

A vane-type compressor is disclosed having a rotor that is disposed eccentrially in a housing cylinder. Vane sliders are guided in the rotor so that they deviate by a few angular degrees from the radial direction. Elastic O-rings are provided in end-face ring grooves of the rotor, which rings are elastically deformable in their cross-section with the rings acting as noise-reducing spring and damping bodies for the vane sliders when moving adjacent their respective inner dead-center position. For promoting the durability of the O-rings they are constantly twisted by the tangential component of the impact force of the vane sliders inside the ring grooves.

4 Claims, 1 Drawing Sheet

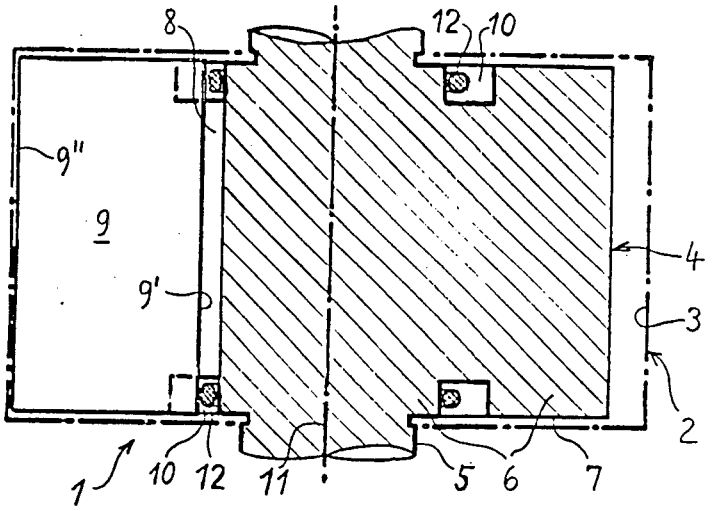
Fig. 2
Fig. 1
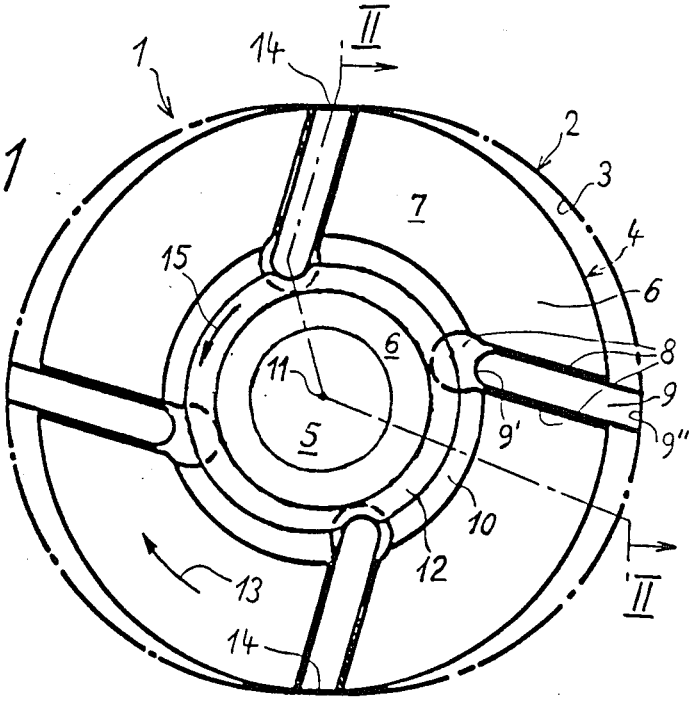

VANE-TYPE COMPRESSOR

The invention relates to a vane-type compressor of a construction having a rotor disposed for rotation inside a housing which exhibits an eccentric inner guide surface engageable with radially slideable vanes carried in grooves of the rotor. In the case of a known compressor of this construction according to DE-AS No. 21 17 102, the vanes are arranged exactly radially with respect to the axis of rotation of the rotor; the elastic rings are continuously in contact with the inner end faces of the vanes and press these against the circular-cylindrical interior surface of the housing cylinder, for which purpose only spring-elastic metallic rings are suitable; and a relativey large free space exists between the rings and the inside diameter of the ring grooves in the rotor. In this case, the elastic rings continuously act on the vane sliders so that their radial contact pressure is reinforced in addition to the centrifugal effect and their wear as well as that of the interior surface is increased. Lacking sufficient vibration damping, the metallic rings also promote the generating of noise caused by the radial and tangential whirring of the vanes.

It is an objective of the invention to further develop a vane-type compressor of the mentioned construction in such a way that it distinguishes itself by very quiet running.

The invention achieves this objective in a surprisingly simple and rationally implementable way by providing ring groove means in the rotor with at least elastically deformable ring means mounted therein for engaging the radially inner end of the vanes when they are at or near their inner dead center positions, the vanes extending at a small angle to the radius so that they serve to twistingly move the ring means inthe ring groove means when the compressor is operated. In preferred embodiments, two ring grooves with corresponding elastic rings are provided at respective opposite axial ends of the rotor. The rings that can be deformed in their cross-section, on the one hand, as elastic stops, dampen the movements of the vanes in the area of their inner dead center position, and, on the other hand, accelerate the initial phase of the radial upward movement of the vanes without causing any increased wear of the outer end faces of the vanes and of the inner surface of the housing cylinder by means of the effect of continuous additional radial force. Also the fatigue strength of the elastic rings themselves is ensured without any additional constructive expenditures by means of their adapted development and arrangement in the ring grooves since by their continuous twisting no excessive local strain occurs.

In the case of certain preferred embodiments, the rings are constructed as circular cross-section O-rings. The circular cross-section of the O-rings results in a particularly advantageous course of the damping and spring-back function by means of the increased deformability of the O-rings as compared to elastic rings having, for example, a rectangular cross-section.

Other objects, advantages and novel features of the present invention will become apparent from the following detailed description of the invention when considered in conjunction with the accompanying drawings.

BRIEF DESCRIPTION OF THE DRAWINGS

FIG. 1 is a frontal view of the rotor of a vane-type compressor with the contour of the inner surface of a pertaining housing cylinder; and FIG. 2 is a longitudinal sectional view according to the Line II—II of FIG. 1.

DETAILED DESCRIPTION OF THE DRAWINGS

A vane-type compressor 1, in a housing cylinder 2 with an elliptically cylindrical inner surface 3, contains a concentrically disposed rotor 4. The rotor 4 consists of an axle shaft 5 and a circular-cylindrical rotor body 6 having radial end faces 7. In the rotor body 6, vanes 9 are disposed in approximately radial slots 8 and are inclined by a few angular degrees from the radial direction in rotating direction, said vanes 9 supporting themselves to the outside against the inner surface 3 of the housing cylinder 2. In the end faces 7 of the rotor body 6, one ring groove 10 respectively is arranged concentrically to the axis of rotation, one O-ring 12 respectively being disposed in said ring grooves 10 that can be elastically deformed in its circular cross-section. The O-rings 12 preferably consist of fluorocaoutchouc (FPM) that withstands the occurring temperatures as well as mechanical and chemical influences, and represent spring and damping bodies that are elastically deformed when impacted by all vanes 9 in their respective inner dead-center position. For this purpose the extent of the radial cross-section, or thickness in the radial direction of the rotor, of the O-rings 12 is larger than the distance of the inner end faces 9' of the vanes 9 from the inside diameter of the ring grooves 10 in the inner dead-center position of the vanes 9.

During the rotation of the rotor 4 in the direction of the Arrow 13, the vanes 9 move radially back and forth within the slots 8. This movement is determined by the inner surface 3 of the housing cylinder 2, along which the vanes slide with their outer end faces 9'' because of the centrifugal effect. The vanes in each case reach there respective inner dead-center position in points 14 of the inner surface 3 that have the shortest distance fron the axis of rotation 11. In this way, the vanes 9 with their inner end faces 9' contact and deform the two O-rings in an area that in each case is in front of to behind their inner dead-center positions during the travel of the vanes. As a result, the O-rings 12 act as spring-elastic and damping stops and prevent that the vanes 9 strike on the inner limiting surfaces of the slots 8 in the rotor body 6 and in the process generate very loud noises. The elastic restoring force of the O-rings, causes acceleration of the vanes from their rest dead-center position also in the case of low rotational speeds of the rotor body 6 with relatively low centrifugal force so that a lifting-off and later occurring re-impacting of the outer end faces 9'' of the vanes 9 from and onto the inner surface 3 of the housing cylinder 2 with a further generating of noise, are also avoided. Outside the area of in front of and after the inner dead-center positions (14) of the vanes 9, the O-rings 12 do not affect the vane sliders 9 so that, in addition to the centrifugal force, no additional contact force on the inner surface 3 and thus also no corresponding wear can occur. Also in the area of the inner dead-center position, the additional contact force from the elasticity of the O-rings remains within narrow limits because, in the case of high rotational speeds, the inertia effect of the vanes 9 uses up a large part of the restoring force of the O-rings.

The tangential component of the impact force of the vanes 9 on the O-rings 12, in the area of the inner dead-center positions (14) of the vanes 9 that is a result of the arrangement of the vanes that deviates from the radial direction, during the operation, causes a constant twisting of the O-rings 12 inside the ring grooves 10 in the direction of the Arrow 15. In this way, the O-rings 12, are stressed evenly over their whole circumference which results in a high stability of the O-rings over the whole useful life of the vane-type compressor.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A vane-type compressor comprising:

a housing cylinder exhibiting eccentric inner housing guide surfaces, a rotor rotatably mounted in said housing cylinder, a plurality of vanes carried by said rotor in substantially radially extending slots so as to be slidably movable in said slots in response to their outer end surfaces acting against the inner housing guide surfaces during relative rotation of the rotor and housing cylinder, at least one ring groove in said rotor which communicates with respective radial inner ends of said slots, and elastic ring means disposed in said at least one ring groove for elastically abuttingly engaging inner end surfaces of the vanes when they are adjacent their respective inner dead center positions, said vanes and elastic ring means being configured such that they are out of contact with one another during substantial portions of the compressor operations when the vanes are away from their inner dead center positions, said slots extending at a slight angle to the radius of the rotor in such a manner that, in operation, the vanes cause the elastic ring means to slide sequentially around the at least one ring groove during sequential engagement and disengagement of the vanes and the elastic ring means.

2. A vane-type compressor according to claim 1, wherein two of said ring grooves are provided, one each at respective opposite axial ends of the rotor.

3. A vane-type compressor according to claim 1, wherein the elastic ring means are respective elastic circular cross-section O-ring means, said O-ring means having a thickness in the radial direction of the rotor which is smaller than the radial depth of the at least one ring groove.

4. A vane-type compressor according to claim 2, wherein the elastic ring means are respective elastic circular cross-section O-ring means, said O-ring means having a thickness in the radial direction of the rotor which is smaller than the radial depth of the at least one ring groove.

* * * * *